US007211749B2

(12) United States Patent
Jenkins

(10) Patent No.: US 7,211,749 B2
(45) Date of Patent: May 1, 2007

(54) ELECTRICAL DISCONNECT LOCKING DEVICE

(76) Inventor: Robert W. Jenkins, 103 Brook Rd., Brandon, MS (US) 39047

( * ) Notice: Subject to any disclaimer, the term of this patent is extended or adjusted under 35 U.S.C. 154(b) by 0 days.

(21) Appl. No.: 11/174,218

(22) Filed: Jun. 30, 2005

(65) Prior Publication Data

US 2006/0010941 A1 Jan. 19, 2006

Related U.S. Application Data

(63) Continuation-in-part of application No. 10/865,453, filed on Jun. 10, 2004, now abandoned.

(60) Provisional application No. 60/478,867, filed on Jun. 16, 2003.

(51) Int. Cl.
*H01H 27/06* (2006.01)

(52) U.S. Cl. ..... 200/43.08; 200/43.04

(58) Field of Classification Search .. 200/43.04–43.08, 200/11 R–11 TW, 564–572, 334
See application file for complete search history.

(56) References Cited

U.S. PATENT DOCUMENTS 1,377,145 A * 5/1921 Briggs et al. ..... 200/43.08
1,437,716 A * 12/1922 Briggs et al. ..... 200/43.08
4,381,037 A * 4/1983 Cuneo ..... 173/170
5,595,290 A * 1/1997 Hsieh ..... 200/571

* cited by examiner

*Primary Examiner*—Michael Friedhofer
*Assistant Examiner*—Lisa Klaus
(74) *Attorney, Agent, or Firm*—Peter A. Borsari

(57) ABSTRACT

An electrical disconnect locking device which can be installed at the weather head of a dwelling in order to connect and disconnect electrical flow from a power source to a dwelling. The locking device comprises a housing having rotating plates than can be rotated in a first direction to matingly engage a pair of female couplings such that electrical current flows freely and that can be rotated in a second opposite direction away from the pair of female couplings such that electrical current is disconnected. The locking device includes a unique key member which is configured to engage a rotating shaft which is in connection with the rotating plates. The use of the unique key member prevents unauthorized access to the locking device.

13 Claims, 2 Drawing Sheets

ELECTRICAL DISCONNECT LOCKING DEVICE

RELATED APPLICATIONS

This application is a continuation-in-part of, and claims the benefit of priority from U.S. patent application Ser. No. 10/865,453, filed in the United States Patent & Trademark Office on Jun. 10, 2004, now abandoned which claims priority from U.S. Provisional Application Ser. No. 60/478,867, filed in the United States Patent & Trademark Office on Jun. 16, 2003.

FIELD OF INVENTION

The present invention relates to an electrical disconnect locking device that is placed in-line between a house weather head and a power pole in order to connect and disconnect the flow of electrical current either by manual means or by remote control means. More particularly, the electrical disconnect locking device comprises a tamper proof housing with rotating plates than can be manually or electronically activated. When the rotating plates are locked in the contact position, electrical current flows freely. When the plates are rotated 90° to an unlocked position, the electrical current is interrupted and disconnected. The device is capable of self-locking in order to prevent unauthorized access.

BACKGROUND OF THE INVENTION

Currently, utility companies experience tremendous loss of both electricity and electric meters in blighted and impoverished areas due to theft. For example, when an electric customer receives a disconnect notice and fails to pay his electric bill, the utility provider sends a service person to the customer's home to disconnect the electric service. Typically, the service person cuts the seal on the meter, pulls the meter, places plastic spacers in the meter base, replaces and reseals the meter. However, the delinquent customer can easily re-connect the service by carefully cutting the seal, removing the plastic spacers and replacing the meter and seal so that it looks like nobody tampered with the meter. A period of days, or even months, can pass before the utility provider discovers that electricity is being stolen. At that point, a service person once again pulls the meter, inserts the plastic spacers and then locks the meter with a conventional locking device.

Numerous locking devices have been developed in order to try and prevent delinquent customers from opening electric meter bases and hot wiring the electricity. A most simple locking device is a brass locking ring, which easily can be removed with a pry bar. Other locks can be removed with conventional bolt cutters. When the delinquent customer is persistent enough, he will break any locking device secured to the meter and hot wire the meter base. A major problem with this type of electricity theft is that a potentially very dangerous situation is created by the wide open hot meter base. For example, a person can reach up and touch the hot meter base and be electrocuted. When the utility provider discovers that the delinquent customer is stealing electricity again, a service technician usually cuts the service wires at the weather head of the home. If this action does not deter the delinquent customer, the utility provider can disconnect service at the utility pole. However, disconnecting service at the utility pole is not an option when the same service cable serves several homes. At this point, the service technician has made four trips to the site of the delinquent user.

None of the prior art locking devices are completely effective in deterring theft of electricity because the conventional locking devices are designed to lock the meter base. Thus, a need still exists for a locking device which will connect and disconnect power at the weather head of a dwelling. The installation of such a device should deactivate the meter base and render the meter base cold. Also, such a device should discourage the delinquent customer from destroying the meter base or stealing the meter. Moreover, such a device should require only one trip by a service technician. In addition, such a device should leave the meter base cold in order to prevent injury or death. Further, such as device should save the utility provider money by preventing theft of electricity and loss of meters, which in turn can help lower utility rates.

SUMMARY OF THE INVENTION

Accordingly, it is an object of the present invention to provide an electrical disconnect locking device which is installed at the weather head of a dwelling in such a manner that electrical power can be connected and disconnected at the weather head.

It is another object of the present invention to provide an electrical disconnect locking device which will deactivate a meter base and render the meter cold.

It is also an object of the present invention to provide an electrical disconnect locking device which will discourage delinquent customers from breaking into meters and destroying meter bases.

It is a further object of the present invention to provide an electrical disconnect locking device which can be easily installed by a service technician.

Additional objects, advantages and novel features of the invention will be set forth in part of the description which follows, and in part will become apparent to those skilled in the art upon examination of the following specification or may be learned by practice of the invention.

These and other objects of the present invention are accomplished by providing an electrical disconnect locking device which is installed at the weather head of a dwelling and which comprises a tamper proof housing having rotating plates than can be manually or electronically activated. The rotating plates rotate between contact with two female couplings in a locked position and contact with two housing stops in an unlocked position. In the locked position, electrical current flows freely while in the unlocked position, electrical current is disconnected.

BRIEF DESCRIPTION OF THE DRAWINGS

The present invention will be better understood with reference to the appended drawing sheets, wherein.

DETAILED DESCRIPTION

Figure 1:
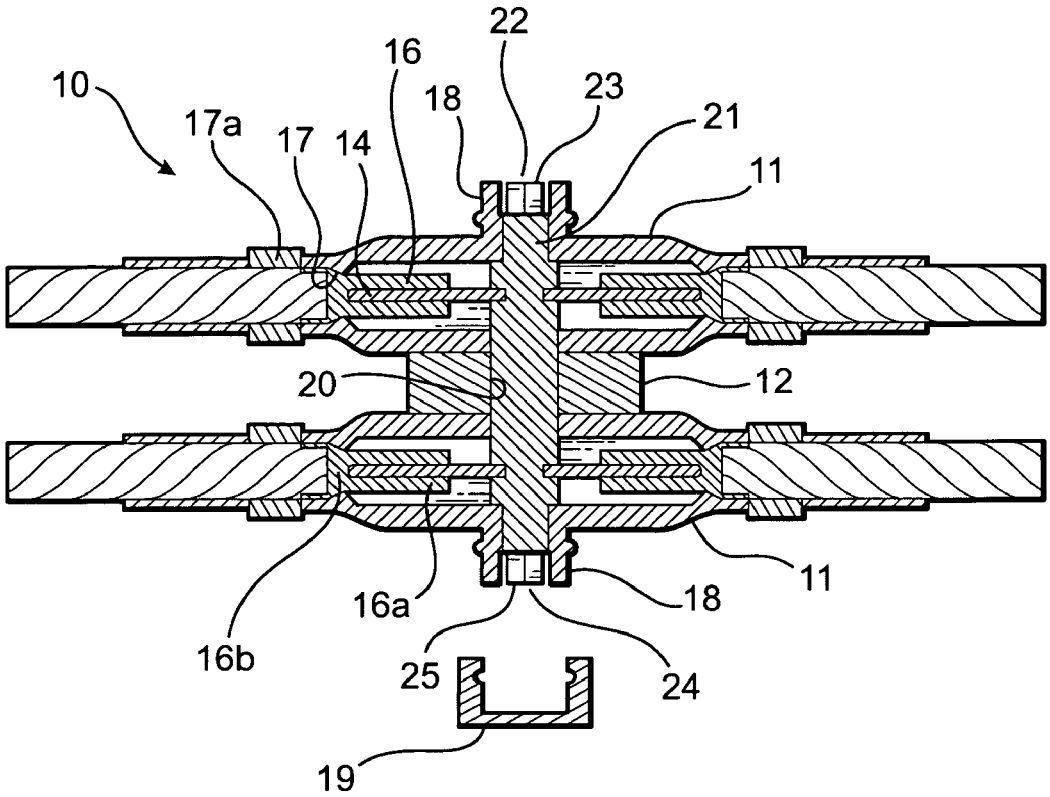
FIG. 1 is a top view of the locking switch of the present invention.
Figure 2:
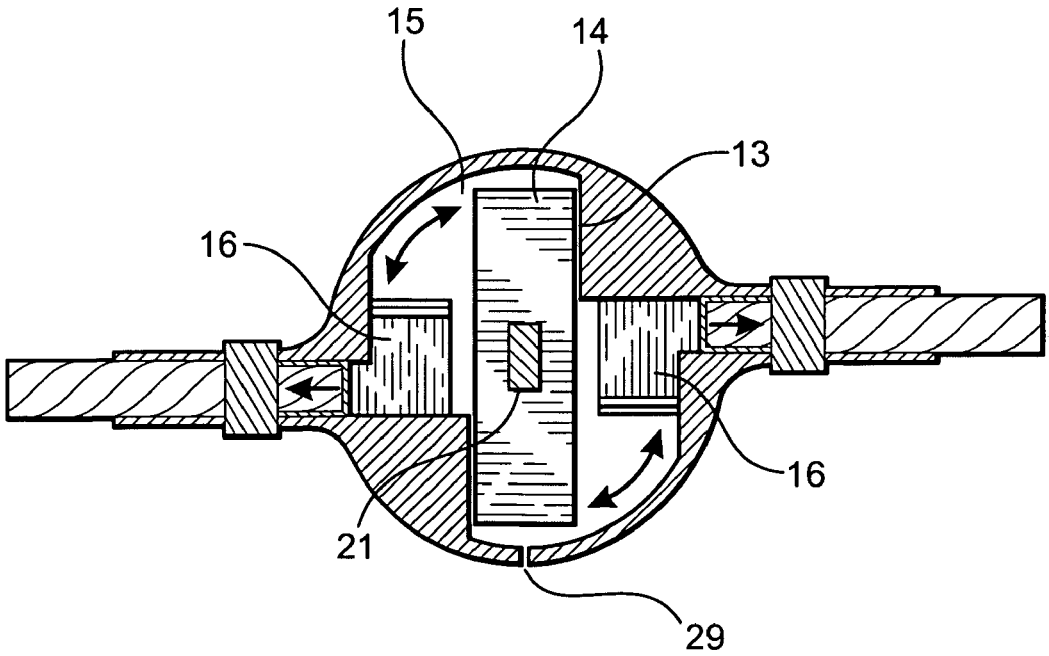
FIG. 2 is a side view of the locking switch of the present invention.

Referring to FIGS. 1 and 2, the locking switch 10 of the present invention comprises two non-conductive housings 11 joined or bound together by a housing link 12. Each housing 11 and the housing link 12 is constructed from a non-conductive, weather-proof material and preferably is formed by a conventional molding process. Non-conductive, weather-proof materials suitable for use in the present invention include, for example, nylon and plastic materials. Each housing comprises a rotating plate 14 disposed within a concave cavity 15, said rotating plate configured to rotate about 90°, a pair of female couplings 16, two housing stops 13, and preferably a condensate weep hole 29. Each rotating plate 14 is composed of a conductive material that permits electrical current flow when in contact each the pair of female couplings 16.

Each of the pair of female couplings 16 comprises a proximal end 16*a* which is fitted within the concave cavity 15 and a distal end 16*b* which is disposed within a channel opening 17 of the housing 11. Proximal end 16*a* of each female coupling is designed to matingly contact said rotating plate 14. Distal end 16*b* is configured to retain electrical wiring of different sizes, either by crimping or other connection methods well known in the prior art. A weather proof seal 17*a* can be provided at the channel opening.

A rotating shaft 21 is disposed centrally through both housings 11 and the housing link 12 and through each rotating plate 14. The rotating shaft 21 is connected to each rotating plate such that is capable of rotating each of the rotating plates 14. The shaft at the rotating plate connection can be of any suitable geometrical shape, such as square or rectangular, as long as the shaft is secured to the plate at the rotating plate connection. The shaft 21 is composed of a strong, non-conductive material.

In the embodiment shown in the Figures, shaft 21 is disposed in a longitudinal bore 20 which runs through the two housings 11, link 12 and two rotating plates 14, the bore terminating at each end through a snap ring 18 molded within each housing 11. Each snap ring 18 is configured such that it can receive and retain a snap-on cap 19. Preferably, each snap-on cap is composed of a weather proof material, such as rubber or hard plastic.

Shaft 21 comprises a first end 22 having a first configured shape 23 and a second end 24 having a second configured shape 25. In the embodiment shown, first configured shape 23 is in the form of a pentagon and second configured shape 25 is in the form of a triangle. However, it is to be understood that any geometrical design is suitable for use for the first and second configured shapes. The first and second ends of the shaft 21 preferably are disposed within the molded snap rings 18 of the housings 11.

Figure 3:
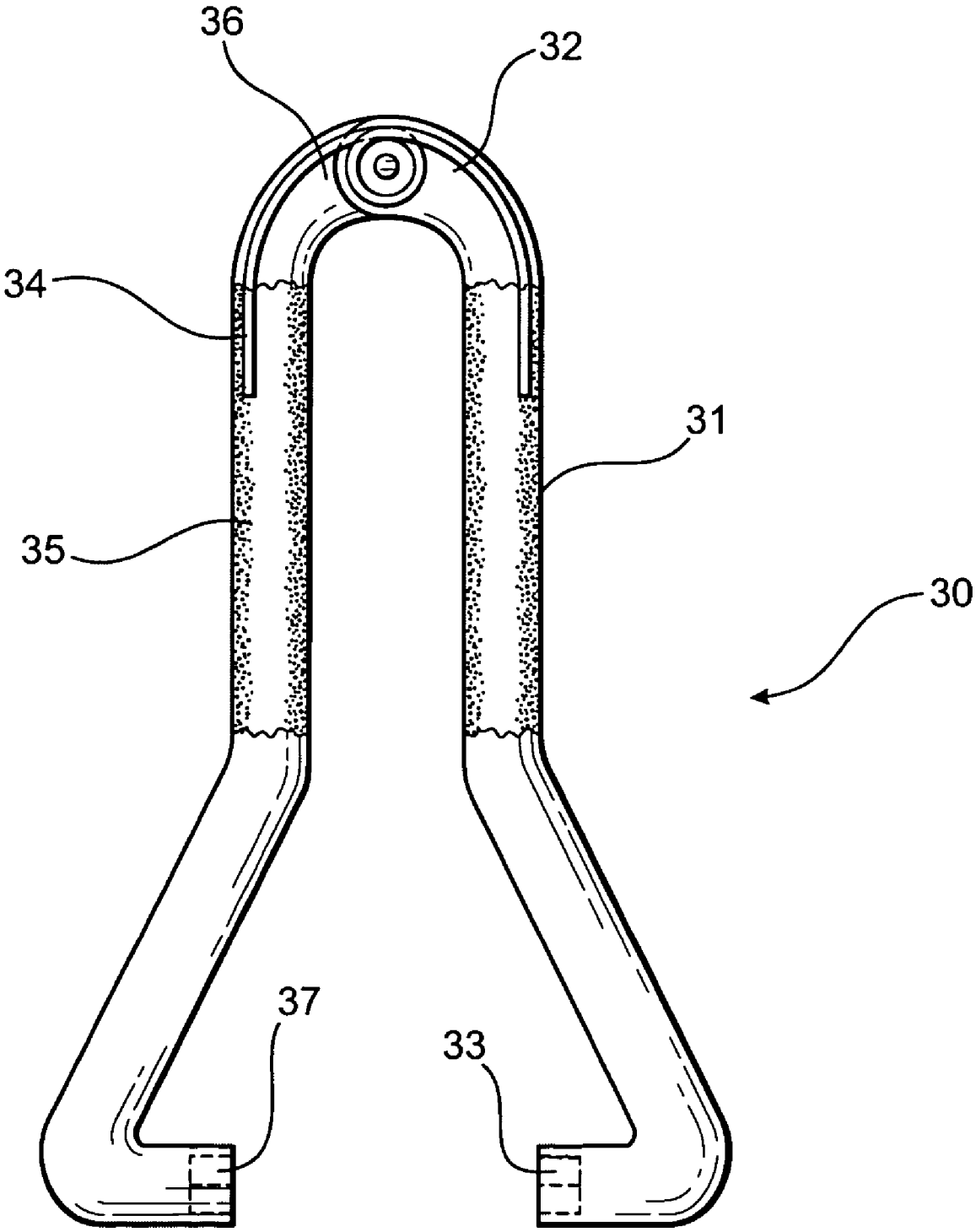
FIG. 3 is a side view of a key configured to lock/unlock the locking switch of the present invention.

Referring now to FIG. 3, a key member 30 is shown which is designed to lock and unlock electrical current in the locking switch of the present invention. The key member is composed of a strong, durable and non-conductive material. The key member 30 comprises a first arm 31 having a first arm end 32 and a second arm 35 having a second arm end 36, the first and second arms being joined at first and second arm ends by means well known in the art, such as by a rivet. Preferably the first and second arms are joined with a spring-loaded connection 34.

First arm 31 further comprises a key end 33 distal to said first arm end 32; second arm 35 further comprises a key end 37 distal to said second arm end 36. Both key ends 33 and 37 are configured with a specific geometric shape corresponding to the first and second configured shapes 23 and 25. More particularly, key ends 33 and 37 are designed as female complements to the configured shapes 23 and 25. For example, in the embodiment shown in FIGS. 1 and 3, the first configured shape 23 is in the form of a pentagon and the key end 33 is in the form of a complementary female pentagon such that key end 33 can matingly engage configured shape 23. Similarly, second configured shape 25 is in the form of a triangle and the key end 37 is in the form of a complementary female triangle such that key end 37 can matingly engage configured shape 25.

In operation, the electrical disconnect locking device of the present invention is installed at the weather head of a dwelling and the connecting wires from the weather head are introduced into the distal ends 16*b* of the pair of female couplings 16 and retained therein by standard crimping methods. A service technician disconnects electrical current to the weather head by engaging key ends 33 and 37 of key 30 with the corresponding configured shapes 23 and 25 disposed at first and second ends 22 and 24 respectively of shaft 21, turning shaft 21 to rotate each of the rotating plates 14 until each rotating plate contacts the two housing stops 13. When the electrical service is to be re-initiated, each rotating plate 14 is rotated to the locked position whereupon it contacts the pair of female couplings 16 and the flow of electric current begins.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. An electrical disconnect locking device comprising:

a. two non-conductive housings joined by a housing link, each of said housings comprising:

1. a concave cavity;
2. a rotating plate disposed within said concave cavity, said rotating plate configured to rotate about 90°, and
3. a pair of female couplings, each of said pair of female couplings comprising a proximal end disposed within said concave cavity and a distal end, said proximal end of each of said pair female couplings configured to matingly contact said rotating plate and said distal end of each of said pair of female couplings configured to retain electrical wiring, b. a rotating shaft disposed longitudinally through said two non-conductive housings and through said rotating plate of each housing, said rotating shaft being connected to each rotating plate in such a manner that rotating of said rotating shaft causes the rotation of each rotating plate, said rotating shaft have a first end in the form of a first configured shape and a second end in the form of a second configured shape, and c. a key member comprising a first arm and a second arm, said first arm having a first key end provided with the female complement of said first configured shape, said second arm having a second key end provided with the female complement of said second configured shape, wherein, when connecting wires from a weather head of a dwelling are introduced and retained within said distal ends of said female couplings, the flow of electrical current can be discontinued by rotating said rotating plate disposed within each of said housings away from said proximal ends of said female couplings and into contact with said two housing stops.

2. The electrical disconnect locking device in accordance with claim 1, wherein connecting wires from a weather head are retained with said distal ends of said female couplings by conventional crimping methods.

3. The electrical disconnect locking device in accordance with claim 1, wherein said rotating plate is composed of a conductive material.

4. The electrical disconnect locking device in accordance with claim 1, wherein when said first and second key ends matingly engage the corresponding first and second ends of said rotating shaft, then said rotating shaft can be rotated.

5. The electrical disconnect locking device in accordance with claim 1, wherein said first configured shape is in the form of a pentagon and said second configured shape is in the form of a triangle.

6. The electrical disconnect locking device in accordance with claim 1, wherein said key member and said rotating shaft are each composed of a non-conductive material.

7. The electrical disconnect locking device in accordance with claim 1, wherein said first arm and said second arm of key member are joined with a spring loaded connection.

8. The electrical disconnect locking device in accordance with claim 1, further comprising a longitudinal bore through each of said housings, said rotating shaft being disposed within said longitudinal bore, said longitudinal bore terminating at each end through a snap ring molded within each of said housings.

9. The electrical disconnect locking device in accordance with claim 8, wherein each snap ring is provided with a removable snap-on cap.

10. The electrical disconnect locking device in accordance with claim 8, wherein said first and second ends of said rotating shaft are disposed within said cap rings.

11. The electrical disconnect locking device in accordance with claim 1, wherein each of said housings further comprises a condensate weep hole.

12. The electrical disconnect locking device in accordance with claim 1, wherein each of said housings further comprises a pair of channel openings within with the distal end of each of the pair of female couplings is disposed.

13. The electrical disconnect locking device in accordance with claim 1, wherein a weather proof seal is provided at each of said pair of channel openings.

* * * * *